United States Patent [19]

Bomberger et al.

[11] 4,402,541

[45] Sep. 6, 1983

[54] MOVABLE LOAD BAR WITH AUTOMATIC HOOKS

[75] Inventors: Arthur L. Bomberger, Mount Gretna, Pa.; Claris E. Johnson, Jr., Alexis, Ill.

[73] Assignee: Butler Manufacturing Company, Kansas City, Mo.

[21] Appl. No.: 352,524

[22] Filed: Feb. 26, 1982

Related U.S. Application Data

[63] Continuation-in-part of Ser. No. 183,740, Sep. 3, 1980, abandoned.

[51] Int. Cl.[3] ..... B66C 1/18

[52] U.S. Cl. ..... 294/81 R; 294/116

[58] Field of Search ..... 294/81 R, 88, 99 B, 294/100, 116, 110 B, 118, 106, 67 R, 67 BB, 67 BC

[56] References Cited

U.S. PATENT DOCUMENTS

| | | | |
|---|---|---|---|
| 1,772,437 | 8/1930 | Henderson | 294/116 |
| 2,654,632 | 10/1953 | Herbert | 294/116 |
| 3,386,646 | 2/1967 | Flora, Jr. | 294/81 R |

*Primary Examiner*—James B. Marbert

*Attorney, Agent, or Firm*—Shoemaker and Mattare Ltd.

[57] ABSTRACT

A load bar is movably supported from overhead support equipment and has grabbing hooks thereon which are adaptable to support loads having a wide variety of shapes and/or sizes.

14 Claims, 10 Drawing Figures

MOVABLE LOAD BAR WITH AUTOMATIC HOOKS

BACKGROUND OF THE INVENTION

The present application is a continuation-in-part of Application Ser. No. 183,740, filed Sept. 3, 1980, now abandoned.

The present invention relates in general to load carrying devices, and, more particularly, to overhead load carrying devices.

The assignee of the present invention is required to paint a wide variety of structural members. These members vary in shape, width and length. Being able to effectively and automatically grab these members and run them through a paint line is a constant problem. Currently, structural elements are individually hooked by paint-line personnel through holes or other convenient parts on that structural element.

There is need for a device for supporting such structural elements and which is quickly and easily attached to and detached from a wide variety of such elements and is capable of moving such elements through an environment which is potentially damaging to such supporting equipment.

SUMMARY OF THE INVENTION

The device embodying the teachings of the present invention includes movable grabbing arms which grasp a structural element to be supported. The arms are moved by an actuator rail which is controlled by a hydraulic cylinder or air cylinder arrangement. The device is supported from plant overhead handling equipment and is movable along any preselected path.

The device embodying the teachings of the present invention automatically grabs the element to be supported and can accommodate a wide variety of element shapes, sizes and weights.

OBJECTS OF THE INVENTION

It is a main object of the present invention to movably support a wide variety of elements with an overhead load carrying device.

It is another object of the present invention to provide an overhead load carrying device which is quickly and easily adaptable to elements having a wide variety of shapes, sizes and weights.

It is yet another object of the present invention to movably support elements subjected to potentially damaging environments.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
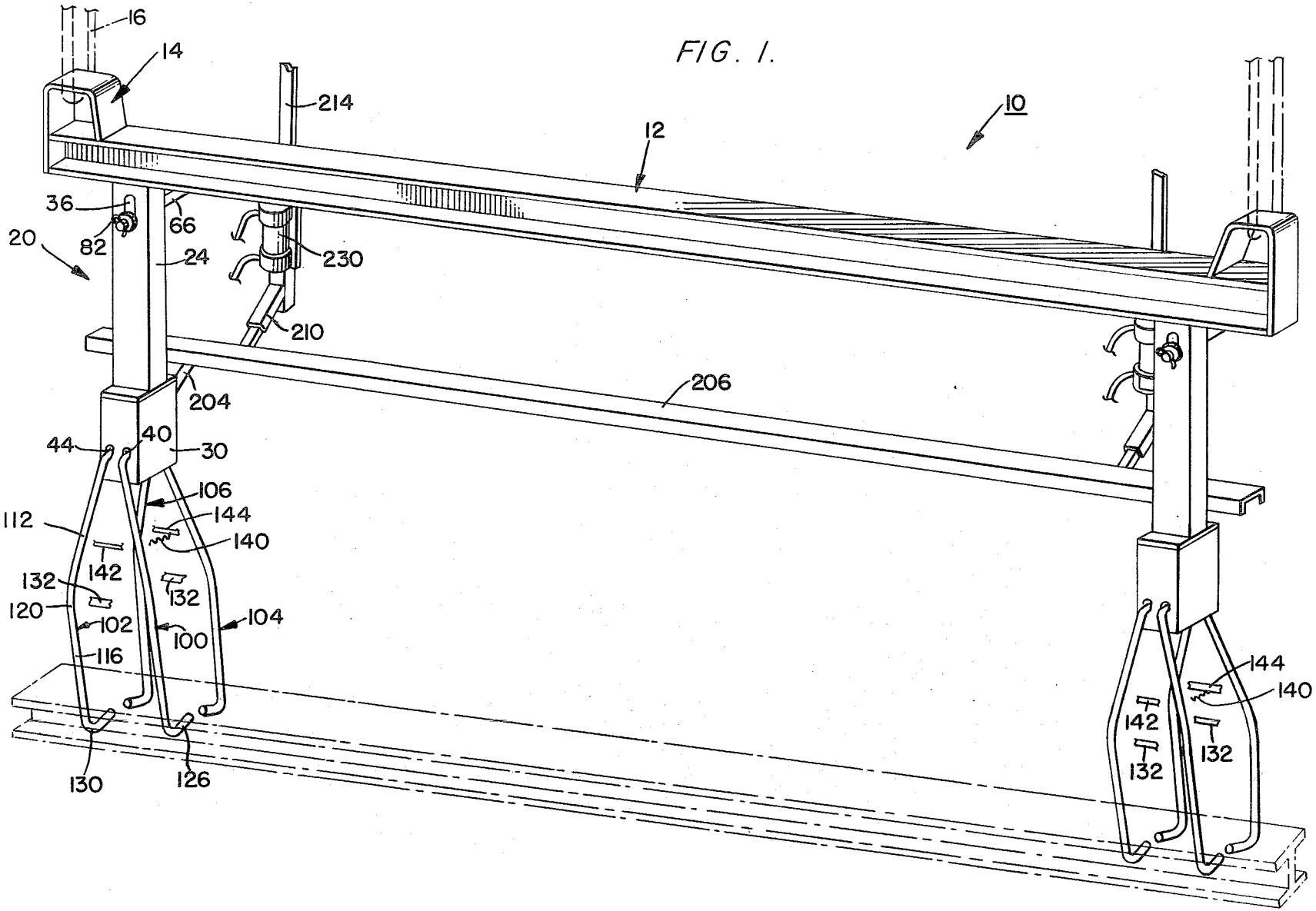
FIG. 1 is a perspective view of a load carrying bar embodying the teachings of the present invention.

Shown in FIG. 1 is a load carrying device 10 which is suspended overhead for supporting a wide variety of elements, such as beams, or the like. The device 10 includes a support beam 12, such as an I-beam, or the like, attached to a trolley or to further overhead support means by attachment frames 14, or the like, suspended from hangers 16. The frames can be attached to the beam by welding or the like. The beam is movable for transporting material from one place to another.

Figure 3:
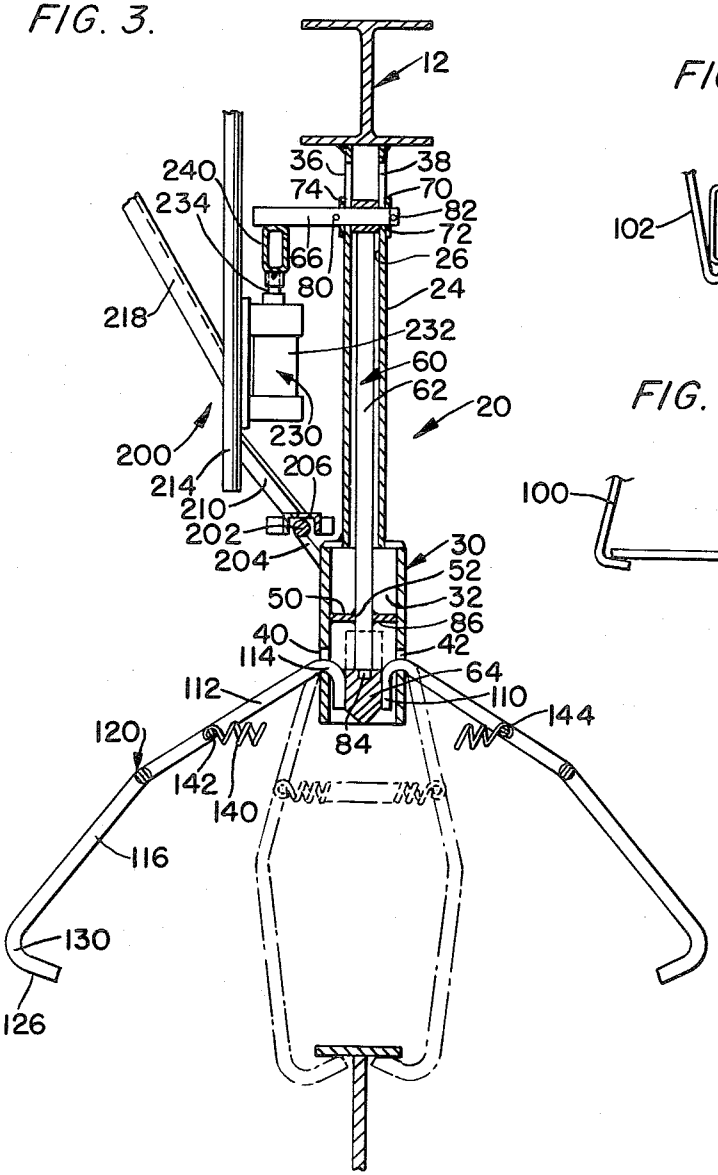
FIG. 3 is view taken along line 3—3 of FIG. 2.

As best shown in FIGS. 1 and 3, the device 10 includes a pair of carriage members 20 depending from the beam 12. Each carriage member includes a housing 24 attached, as by welding, at one end thereof to the beam and depending downwardly therefrom. As shown in FIG. 3, the housing is hollow and has a bore 26 defined longitudinally therethrough. A sheath 30 is attached as by welding at one end thereof to the lower end of the housing 24 to depend therefrom. The sheath is hollow and has a bore 32 defined longitudinally thereof to be aligned with the bore 26 of the housing.

As shown in FIGS. 1 and 3, aligned slots 36 and 38 are defined in the housing 24, and pairs of aligned slots 40, 42, 44 and 46 are defined in the sheath.

A guide plate 50 is fixed on rod element 60 and extends transversely across the bore 32.

Acutator rod element 60 is movably mounted within the bores 26 and 32 and includes a shaft 62 and a wedge-shaped head 64 which is wedge-shaped in cross-section on one end of the shaft and a coupling tube 70 on the other end of the shaft. The head 64 extends the width of the sheath for a purpose which will be evident from the ensuring disclosure.

A coupling bar 66 extends transversely of the housing, and this bar is fitted through the aligned slots 36 and 38 and coupling tube 70 and retained with washers 72 and 74 along with cotter pins 80 and 82.

Shaft 62 is coupled to the head 64 by a stub shaft 84. The head 64 is movable in the sheath from the solid line position in FIG. 3 to the phantom line position in FIG. 3 by movement of the actuator rod 60 via the coupling bar in the slots 36 and 38.

Figure 4:
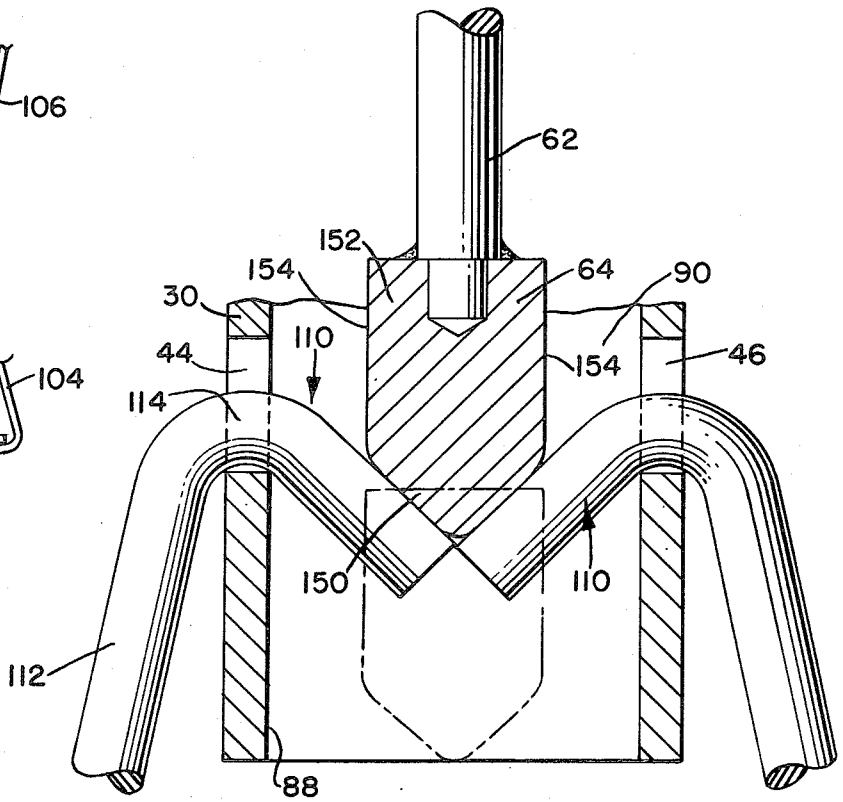
FIG. 4 is a cutaway view of the top portion of the pivotally supported grabbing arms used in the device embodying the teachings of the present invention.
Figure 5:
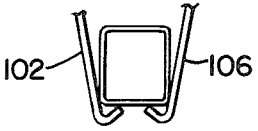
FIGS. 5–7 show elements of various shapes and sizes being supported from the device embodying the teachings of the present invention wherein the gripping arms automatically accommodate such variety of shapes and sizes.
Figure 6:
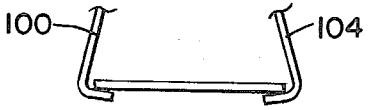
Figure 7:
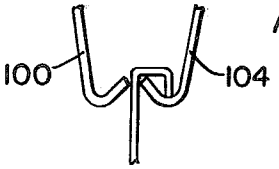

As shown in FIGS. 3 and 4, the head 64 is spaced from inside surface 88 of the sheath to define an annulus 90. Grabbing arms 100, 102, 104 and 106 are mounted in the slots 40, 44, 42 and 46, respectively. Each of the grabbing arms is integral and unitary and each includes a top fulcrum portion 110 connected to a top portion 112 by a bend 114. The top portion 112 is connected to a lower portion 116 by a double bend 120 which angles downwardly and outwardly with respect to the top portion in the grabbing arm positions shown in the figures. The double bend is best indicated by comparing FIGS. 1 and 3. A lower hook portion 126 is connected to the lower portion 116 by a return bend 130.

Adjacent grabbing arms are connected together by a coupling element 132 and act in tandem. Paired grabbing arms are connected by yieldable elements, such as an extension spring 140 mounted at the ends thereof on spanner bars 142 and 144 on each pair of adjacent grabbing members. Alternatively, yieldable means, such as a leaf spring, or the like, can be mounted at an end on each spanner bar and at the other end on the sheath. The yieldable members bias the paired grabbing arms toward each other, or toward the position shown for the grabbing arms in phantom lines in FIG. 3. The grabbing arms pivot about the fulcrum bend 114 outwardly away from each other for loading and unloading, and inwardly toward each other for load bearing as indicated in FIG. 3. The lower hooks of each arm engage the item to be supported as shown in FIGS. 3, 5, 6 and 7.

As shown in FIG. 4, the head 64 includes a tapered nose 150 integrally and unitarily mounted on a body 152 which has planar sides 154. The nose 150 abuts the top fulcrum portions of the grabbing arms and forces those portions apart as that head 64 moves downwardly. As those portions separate, the grabbing arms move outwardly against the bias of the yieldable elements. The degree of bend in the fulcrum portion is adjusted so that the arms move outwardly far enough to accommodate any item which can be safely suspended from the device 10. The fulcrum portions seat against the planar sides 154 of the head and are locked outwardly in a cocked position as shown in FIG. 3 in solid lines. The head is thus wedged between the grabbing arms fulcrum portions and acts as a lock to maintain those arms apart. The slots 40 through 46 are sized to permit such grabbing arm action and easy assembly and disassembly.

Figure 2:
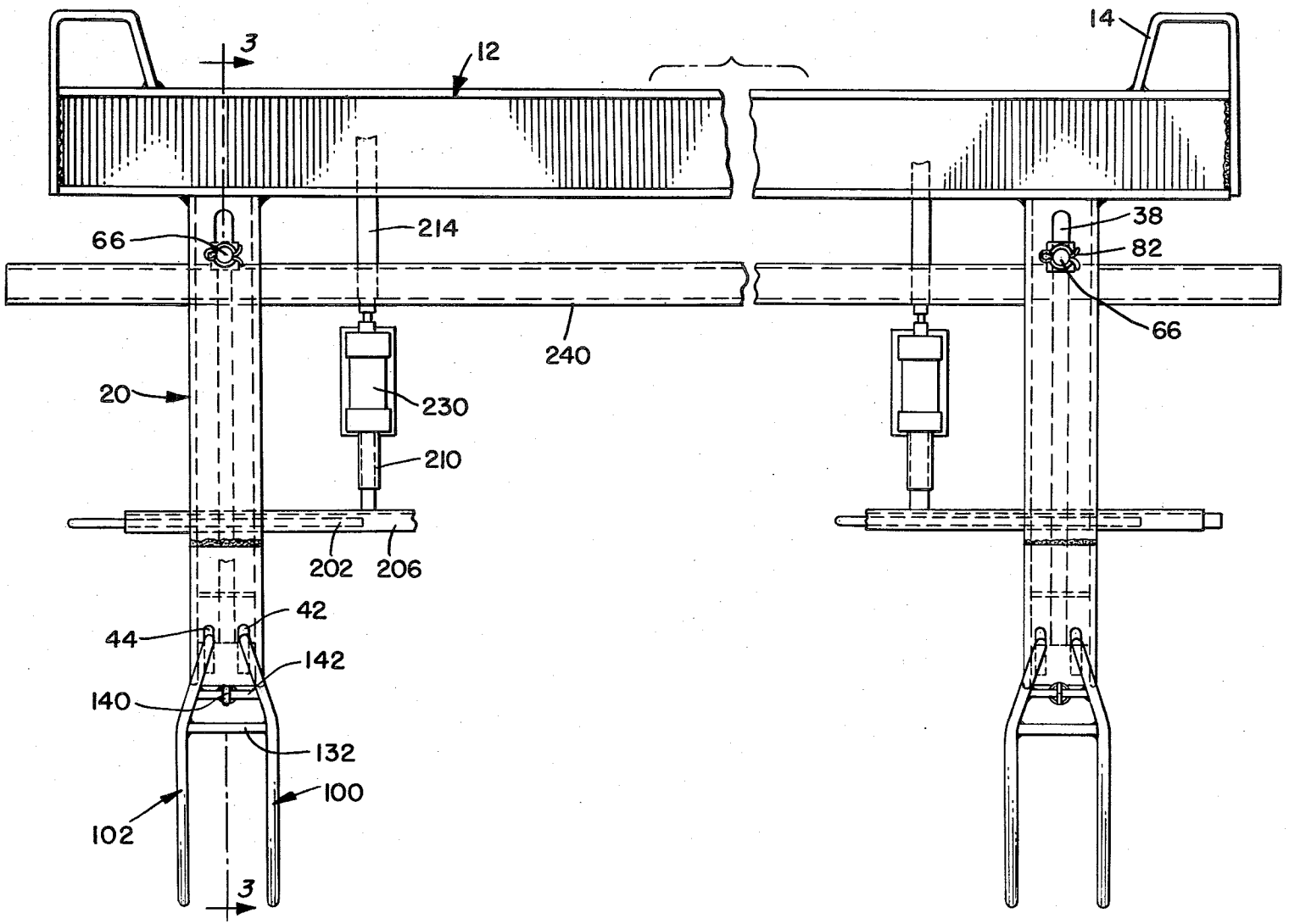
FIG. 2 is an elevation view of the load carrying bar shown in FIG. 1.

The alignment of load carrying device 10 at load and unload stations is controlled by arm moving means 200 best shown in FIG. 3. The moving means 200 includes a bar 202 mounted on the sheath by an arm 204 to extend longitudinally of the overhead support beam 12. A guide rail 206 is U-shaped in transverse cross-section and partially surrounds the bar 202 as indicated in FIGS. 2 and 3.

A strut 210 is mounted at one end thereof on the guide rail and extends upwardly and angularly away from that guide rail. A mounting brace 214 is affixed to the other end of the strut 210. The brace is supported either at the ends thereof or by means of a further brace 218 which is affixed at one end thereof to the brace 214 and at the other end thereof to a suitable mounting element.

Grabbing action is controlled by a fluid or air cylinder 230 mounted on the brace 214 and includes a piston housing 232 with a piston rod 234 extending upwardly therefrom. Suitable fluid connections are indicated in FIG. 1 and connect the cylinder 230 to a source and/or a sink of fluid (not shown), as well as a fluid pump (not shown), or the like, to drive fluid into and out of that cylinder to operate the device 230. Suitable controls and/or regulators (not shown) can also be included for further controlling the cylinder 230.

The cylinder piston is connected to an actuator rail element 240 which moves coupling bar 66 and rod element 60 up at load station in response to movement of the cylinder piston rod 234. As shown in FIG. 2, the actuator rail element spans the grabbing arm housings. Movement of the piston rod 234 outwardly of the cylinder 230 raises the rod element 60, and hence permits spring loaded closing of the grabbing arms. Movement of the rod element 60 downwardly thereby forces the head 64 between the caliper arms, thereby forcing those arms outwardly into the cocked position shown in solid lines in FIG. 3, such as at the unload station.

The grabbing arms can be hand operated by manually moving the coupling bar 66, if so desired, and can be reset manually, or by other suitable means after being opened.

Figure 8:
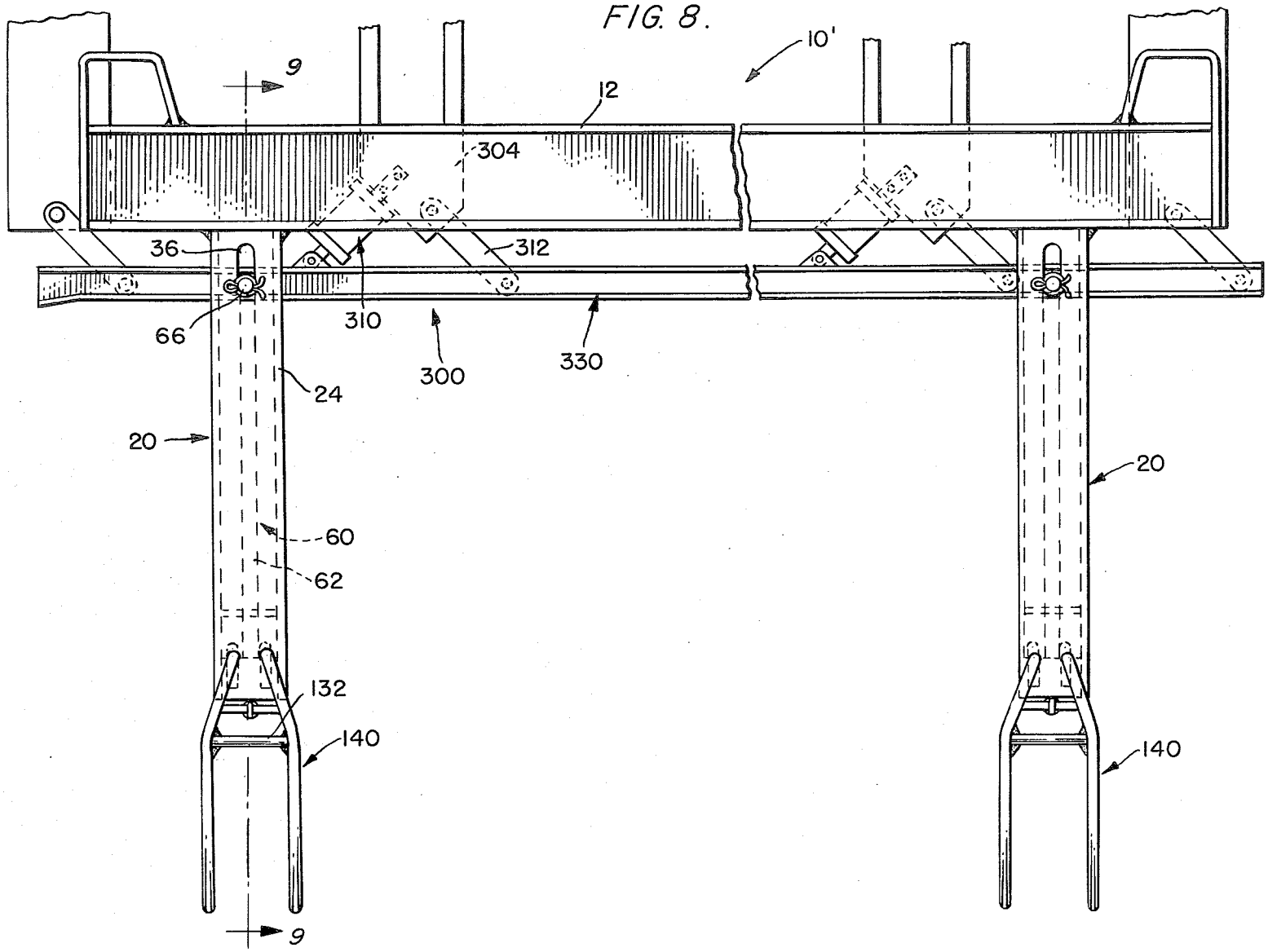
FIG. 8 is an elevation view of an alternative embodiment of the load carrying bar embodying the teachings of the present invention.
Figures 9, 10:
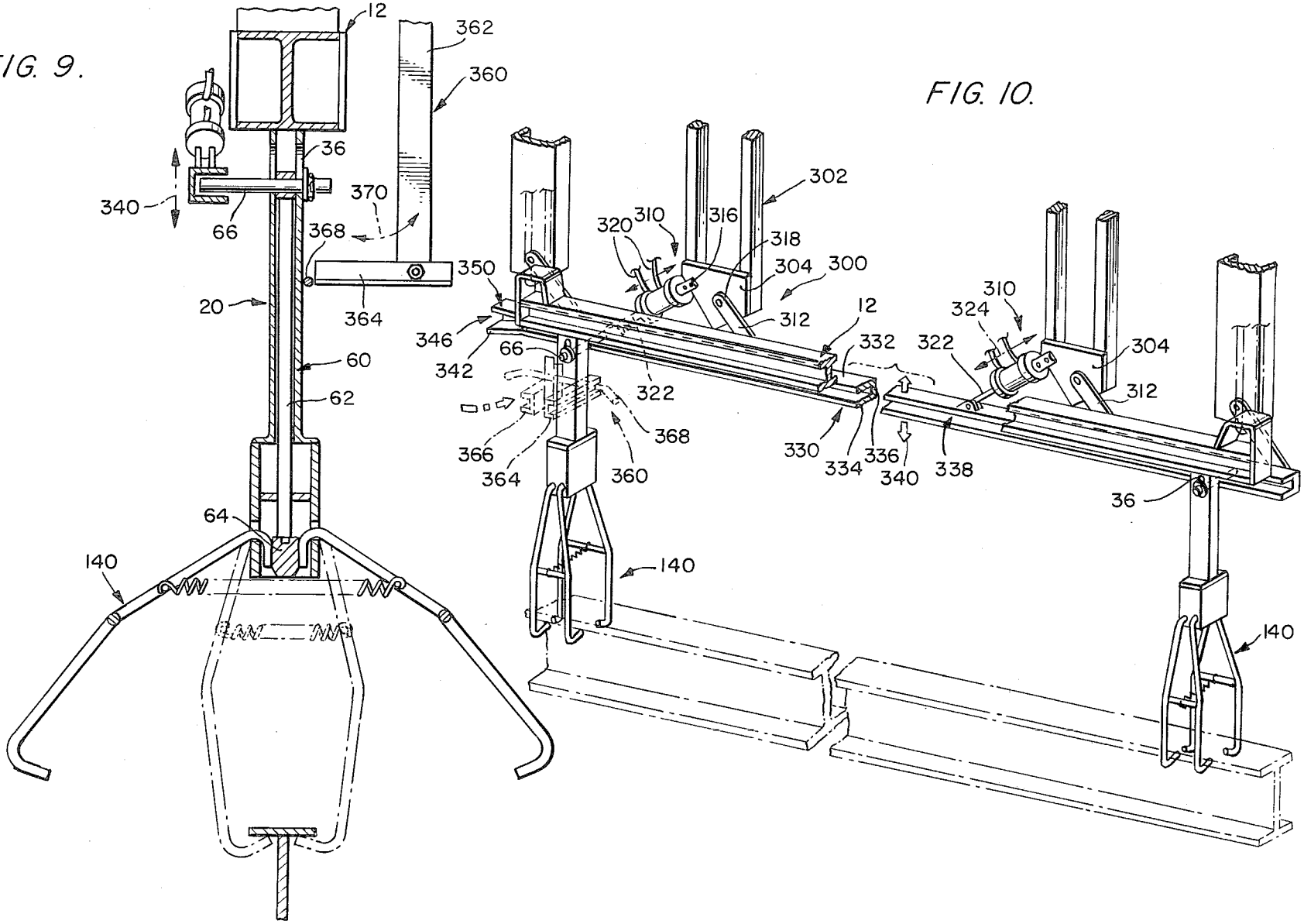
FIG. 9 is a view taken along line 9—9 of FIG. 8.
FIG. 10 is a perspective of the alternative embodiment shown in FIGS. 8 and 9.

Shown in FIGS. 8–10 is a load carrying device 10' which is an alternative embodiment of the just-described device 10.

The device 10' includes a support beam 12 attached to a suitable overhead support means. As with the previous embodiment, any suitable means can be used for moving the load beam along a load beam path. Such load beam moving means can include tracks mounted in a building ceiling along with suitable motors, chains, couplings, and the like, for moving the beam in and along the tracks. Suitable switching means can be included in the track system to guide the beam to appropriate portions of the track, such as spurs, turnarounds, or the like.

A pair of carriage members 20 depend from the beam 12 and operate and function in a manner identical to those elements in the device 10. An actuator rod 60 operates the hooks 140 and includes a shaft 62 to which a coupling bar 66 is attached. The bar 66 extends through slots 36 defined in housing 24 of the element 20. A coupling element 132 connects adjacent grabbing arms, and a head 64 operates the grabbing arms as above-described.

An arm moving means 300 includes supports 302 attached to an overhead support and depending therefrom. The arm moving means is located adjacent to the load beam path, and each support includes a plate 304 on the lower end thereof to which is movably attached a fluid cylinder mechanism 310 and a linkage arm 312. Pivot pins 316 and 318 attach the cylinder mechanism and linkage arm, respectively, to the plate.

In both embodiments, the cylinder mechanism can be any suitable fluid cylinder such as a double acting cylinder or the like. The cylinder mechanism includes hydraulic lines 320 and operating arm 322, and operation of the arm 322 is in the direction of arrows 324 in FIG. 10.

The moving means 300 includes operating bar 330 which is U-shaped in transverse cross-sectional shape and includes top flange 332 and bottom flange 334 integrally connected together by web 336. As shown in FIG. 10, the flanges are oriented to be substantially parallel with each other and to define a gap 338 presented toward the support beam 12.

The hydraulic cylinder arms 322 and one end of each of the linkage arms 312 are attached to the actuator bar 330 so that bar moves as the cylinders are operated. The linkage arms convert cylinder initiated movement into bar movement with a vertical component shown by arrow 340 in FIG. 9, and FIG. 10.

Flanges have flared ends 342 and thus an entranceway 346 is defined at one end 350 of the beam 330. The actuating pins 66 are received in the gap 338 to releasably couple those pins to the bar and enter that gap via the entranceway 346 as the support beam 12 moves along a beam path, such as a painting line or the like. Once the pins 66 are positioned in the gap 338, vertical movement of the bar 330 moves those pins vertically, which causes the actuator rod to move vertically to operate the hooks, as above-discussed.

A guide 360 includes a support arm 362 and a pair of support rails 364 and 366 connected thereto. A spanner bar 368 is mounted on the rails to abut housing 24 when the guide 360 is moved into position. The guide is movable in the direction of arrow 370 shown in FIG. 9 and the support is attached to a cealing or the like. Guides 360 are located at selected positions along the load beam movement path to be moved into a housing abutting position when a hook is to be opened or closed. Such guides thus stabilize the hooks during loading and/or unloading operations, but can be moved out of the way at other times.

The grabbing arms of the device 10' can be operated manually if so desired. Other than the above-discussed differences, the device 10' is similar to the device 10.

The load beams disclosed herein permit a load to be moved along a path, such as a paint line, or the like, which includes an environment which might be detrimental to the equipment used to open and close the load supporting means, such as the hooks in this case. The fluid cylinders and actuating bars can be located at positions removed from the damaging environment, and the hollow housings protect the rod elements and hook tops from that environment. The actuating mechanisms can be located at strategic locations along the path so that all desired operations can be performed.

As above-discussed, the load beam and hooks move through the potentially dangerous environment while the actuating mechanisms, with the equipment associated therewith, such as electronic control equipment, fluid cylinders, and the like, can be located at selected "safe" locations, and the load beam moved to those locations when loading and/or unloading operations are desired. These "safe" locations can even be defined by suitable spurs in an overhead track from which the load beam is suspended, if so desired.

The housings and hooks can be constructed of material which will not be damaged by the environment, and can thus, for example, become completely covered with several layers of paint or the like, without having the operation thereof damaged or inhibited.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A device for supporting the moving elements using an overhead carrying means comprising:

a load beam having means for movably attaching said load beam to an overhead structure and moving that load beam along a load beam path;

a hollow housing mounted on said load beam;

a rod element movably mounted within said hollow housing and including a shaft and a wedge-shaped head on one end of said rod element;

rod element moving means located outside of said housing and extending into said hollow housing and coupled to said rod element for moving said rod element within said housing;

an actuating means for actuating said rod element moving means, said actuating means including a hydraulic cylinder supported and maintained at a specific spatial location adjacent to and spaced from said load beam path so that said load beam and housing move past said spatially fixed cylinder as said load beam traverses said load beam path, an operating bar attached to said hydraulic cylinder and maintained at said specific spatial location, operating bar coupling means coupling said operating bar to said hydraulic cylinder so that said operating bar is moved toward or away from said load beam by said cylinder upon actuation of said cylinder, receiving means on said operating bar for releasably coupling said rod element moving means to said operating bar when said load bar is located adjacent to said spatially fixed hydraulic cylinder so that movement of said operating bar toward or away from said load beam causes corresponding movement of said rod element moving means coupled thereto toward or away from said load bar whereby said rod element is moved within said housing upon actuation of said hydraulic cylinder; and a plurality of load grabbing arms located externally of said housing and pivotally supported on said housing, said arms each having a portion thereof located within said housing to be contacted by said rod element head, said arms being located to be pivoted away from said housing by said rod element head when said rod element is moved by said rod element moving means, said grabbing arms having load contacting means thereon which contact a load to be supported.

2. The device defined in claim 1 wherein each of said load grabbing arms includes a body having a first portion on one end thereof which is bent with respect to said body and which is contacted by said rod element head and a hook portion which contacts a load to be supported.

3. The device defined in claim 2 further including biasing means connected to said arms for biasing a pair of said arms toward each other.

4. The device defined in claim 1 wherein said actuating means includes a plurality of fluid power cylinders.

5. The device defined in claim 3 wherein said biasing means includes a spring connected to each of said pair of arms.

6. The device defined in claim 1 wherein said piston head is wedge shaped.

7. The device defined in claim 1 further including a pair of hollow housings mounted on said load beam.

8. The device defined in claim 1 further including guide means on said hollow housing guiding movement of said rod element.

9. The device defined in claim 1 further including a means to guide said load beam into load and unload stations as well as hold said load beam steady.

10. The device defined in claim 9 further including lead-in means on said actuating bar adjacent to said load and unload stations for guiding said rod element moving means into engagement with said actuating bar.

11. The device defined in claim 1 further including linkage means movably attaching said actuating bar to a support means, and means attaching said hydraulic cylinder to said support means.

12. The device defined in claim 9 further including an abutting means located adjacent to said load and unload stations for abutting said hollow housing during a load or unload operation.

13. The device defined in claim 12 wherein said abutting means are movable toward and away from said load beam path.

14. The device defined in claim 1 wherein said actuating bar is U-shaped and has a gap oriented toward said load beam path.

* * * * *